US005190344A

United States Patent [19]

Anderson et al.

[11] Patent Number: 5,190,344

[45] Date of Patent: Mar. 2, 1993

[54] SINGLE MOLD STADIUM SEAT

[76] Inventors: Richard Anderson; Arthur B. Cox, both of P.O. Box 623, Meridian, Id. 83642

[21] Appl. No.: 928,636

[22] Filed: Aug. 13, 1992

Related U.S. Application Data

[63] Continuation of Ser. No. 561,179, Aug. 1, 1990, abandoned.

[51] Int. Cl.[5] ..... A47C 4/04

[52] U.S. Cl. ..... 297/17; 297/378; 297/188

[58] Field of Search ..... 297/17, 378, 188; 16/387; 40/606, 610

[56] References Cited

U.S. PATENT DOCUMENTS

| | | | |
|---|---|---|---|
| 645,878 | 3/1900 | Tennyson | 297/378 X |
| 925,314 | 6/1909 | Durand | 297/17 X |
| 4,298,186 | 11/1981 | Glass | 40/606 X |
| 4,746,166 | 5/1988 | Sadan | 297/17 |
| 4,974,815 | 12/1990 | Glass | 40/610 |

*Primary Examiner*—Kenneth J. Dorner

*Assistant Examiner*—J. Bonifanti

*Attorney, Agent, or Firm*—Frank J. Dykas; Craig M. Korfanta; Ken J. Pedersen

[57] ABSTRACT

A foldable stadium seat (10) is disclosed which is manufactured from a pair of first and second generally planar seat members (11) and (12), which are both products of the same mold. This is made possible by a specific configuration of hinges wherein a first hinge half of a first hinge is attached at one end of the rear edge of the seat member and a second hinge half of a second hinge is positioned at a second end of the rear edge of the seat member. Each of the hinge halves are positioned along the rear edge such that when the rear edge of a second seat member is placed juxtaposition the rear edge of the first seat member, the hinge halves on the two seat members will interfit and can be engaged by a suitable hinge pin (14). Radial stops are formed along the rear edge of both seat members (11) and (12) to provide a radial stop for the foldable single mold stadium seat (10) when it is in the open position, having a first and second seat members (11) and (12) generally perpendicular to one another.

2 Claims, 8 Drawing Sheets

SINGLE MOLD STADIUM SEAT

This application is a continuation of application Ser. No. 07/561,179, filed Aug. 1, 1990 now abandoned.

BACKGROUND OF THE INVENTION

1. Technical Field

This invention generally relates to seats and backrests for use on a bench or stadium bleacher. More particularly, this invention relates to a portable, foldable molded stadium seat wherein both the seat and backrest are manufactured from a single mold.

2. Background Art

Numerous stadium seat designs have surfaced over the last century, and all are designed to provide a maximum degree of comfort while at the same time maintaining both high degrees of portability and convenience.

Currently, the most popular stadium seat design has reinforced seat and backrest cushions, each of which being secured to a light weight tubular frame. The frame is hinged so that it can be folded to place the seat and backrest cushions in a generally parallel disposition, one to the other to facilitate transport and storage of the device. While the seat provides a high degree of comfort, it is relatively bulky when compared to various other prior art solutions and is also relatively expensive and complex to manufacture.

A particularly interesting prior art solution is offered by CLARK, JR., U.S. Pat. No. 4,385,782. CLARK, JR. teaches a stadium seat which is manufactured from a single panel of cardboard, or corrugated paper, and is subsequently folded into a seat and seat back configuration. FUCHS, ET AL., U.S. Pat. No. 4,775,188, teaches a similar cardboard seat which doubles as a carrying case. Obviously, both of the aforementioned cardboard seats are quite transportable and inexpensive to manufacture. On the other hand, they are also not nearly as durable or sturdy as the first mentioned prior art stadium seat. Additionally, the cardboard stadium seats are susceptible to water damage and are therefore not suitable for bad weather use.

What is needed is a foldable stadium seat which is portable, light weight, durable, inexpensive to manufacture, compact for storage and carrying, and at the same time, comfortable to use. Accordingly, it is the object of the instant invention to provide a stadium seat which satisfies these needs.

DISCLOSURE OF INVENTION

This object, and others, is accomplished by a foldable single mold stadium seat which includes a pair of seat members, each being identical to the other. The pair of seat members can be constructed from molded plastic, for instance, and are generally shaped in a planar configuration. Each seat member includes a rear edge having one half of a hinge or hinges connected thereto. The hinge or hinges is/are configured to pivot through a limited arc of travel, generally 100°, to dispose the seat members in one of two positions. The first position, or closed position, has two seat members substantially parallel to one another to facilitate storing and carrying of the stadium seat. The second, or open position, has the two seat members substantially perpendicular one to the other thereby forming a seat and a backrest for the user.

One of the primary advantages of the present invention lies in the configuration of the hinge or hinges. As previously mentioned, each hinge is divided into two halves, where each half is connected to a rear edge of each seat member. Each hinge half is made up of a plurality of hinge lugs held at spaced intervals one from the other. The space between any two adjacent lugs is substantially equal to the width of the individual lugs such that when the two hinge halves are interlocked the lugs on a first hinge half will interfit in the spaces defined by the lugs on the second hinge half and vice versa.

In order for both seat members of the stadium seat to be constructed from a single mold, the hinge lugs must be placed at particular locations along the rear edge of the seat members. The rule for the placement of the lugs can be best understood by dividing the rear edge of the seat member into two equal halves, thereby defining a center point. The lugs must be formed along the rear edge of the seat member in spaced relation one to the other where the spaces between the lugs are approximately equal to the width of the lugs, the lugs all having similar widths.

For the purposes of this example we will assume that we wish to design a stadium seat according to the principles of the instant invention which uses a pair of hinges where each hinge has a pair of halves each having an equal number of lugs, which here we will designate as four hinge lugs to each hinge half. The first four lugs of the first hinge would then be placed at a predetermined distance away from the center point on, say, the right side of the seat member. The first four lugs of the first half of the second hinge would then be positioned on the left side of the seat member but at a distance which is exactly one lug width greater or less than the first predetermined distance. The principle works for both even and odd numbers of hinges and for even and odd number of lugs within each set of hinges, providing that no one lug or set of lugs is centered on the middle point of the back edge.

BEST MODE FOR CARRYING OUT INVENTION

Figure 1:
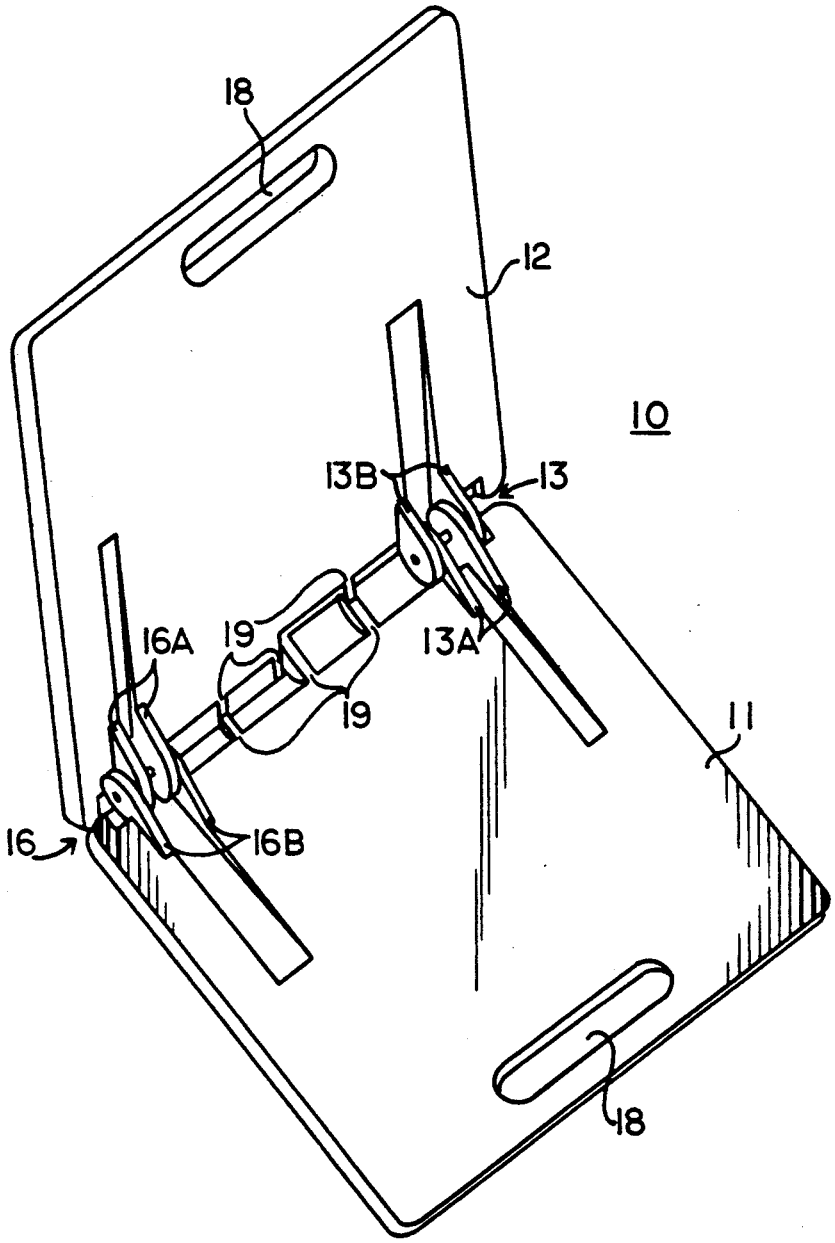
FIG. 1 is a ¾ elevation view of the foldable single mold stadium seat.
Figure 2:
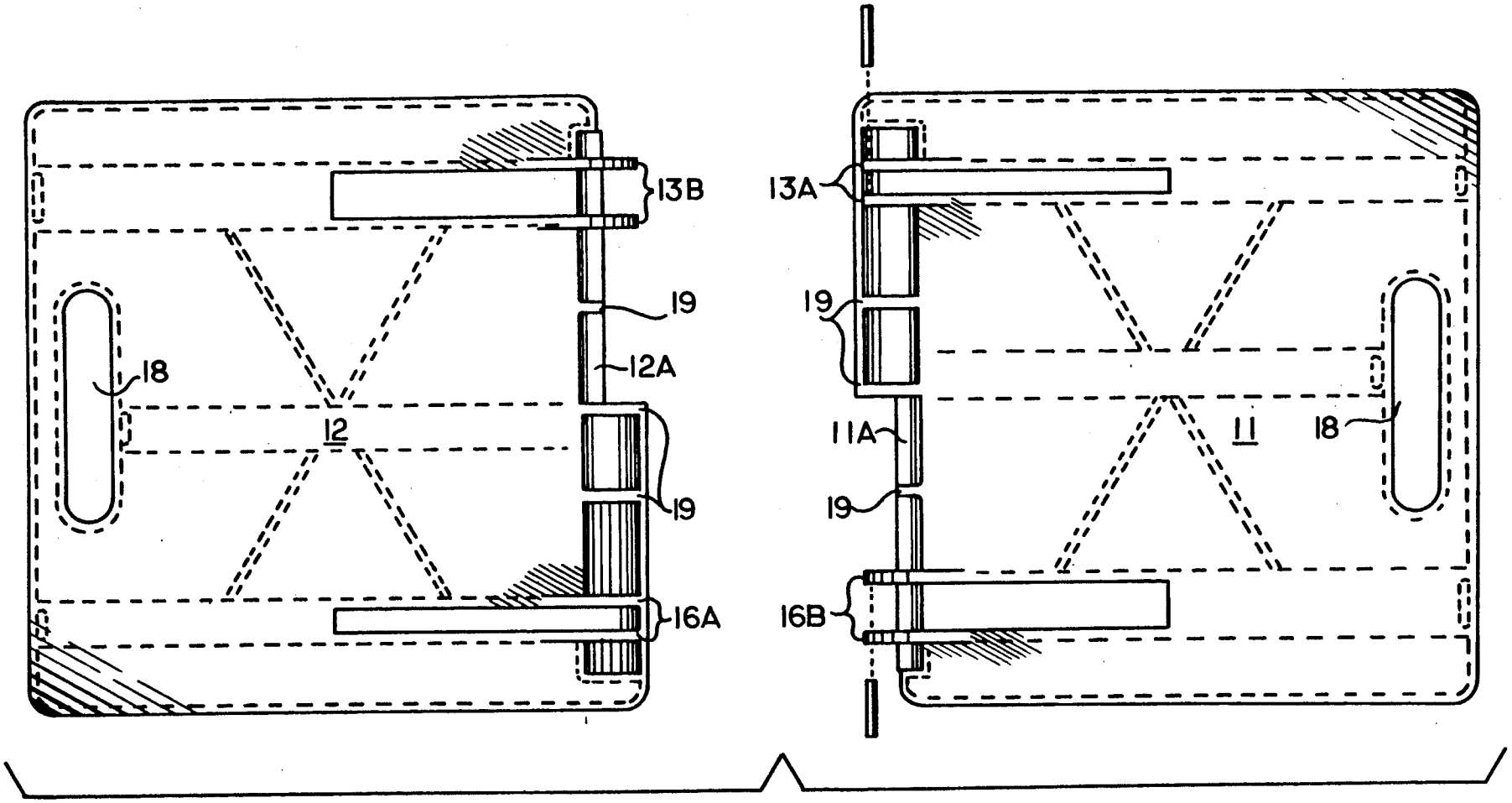
FIG. 2 is a top plan exploded view of the foldable single mold stadium seat.
Figure 3:
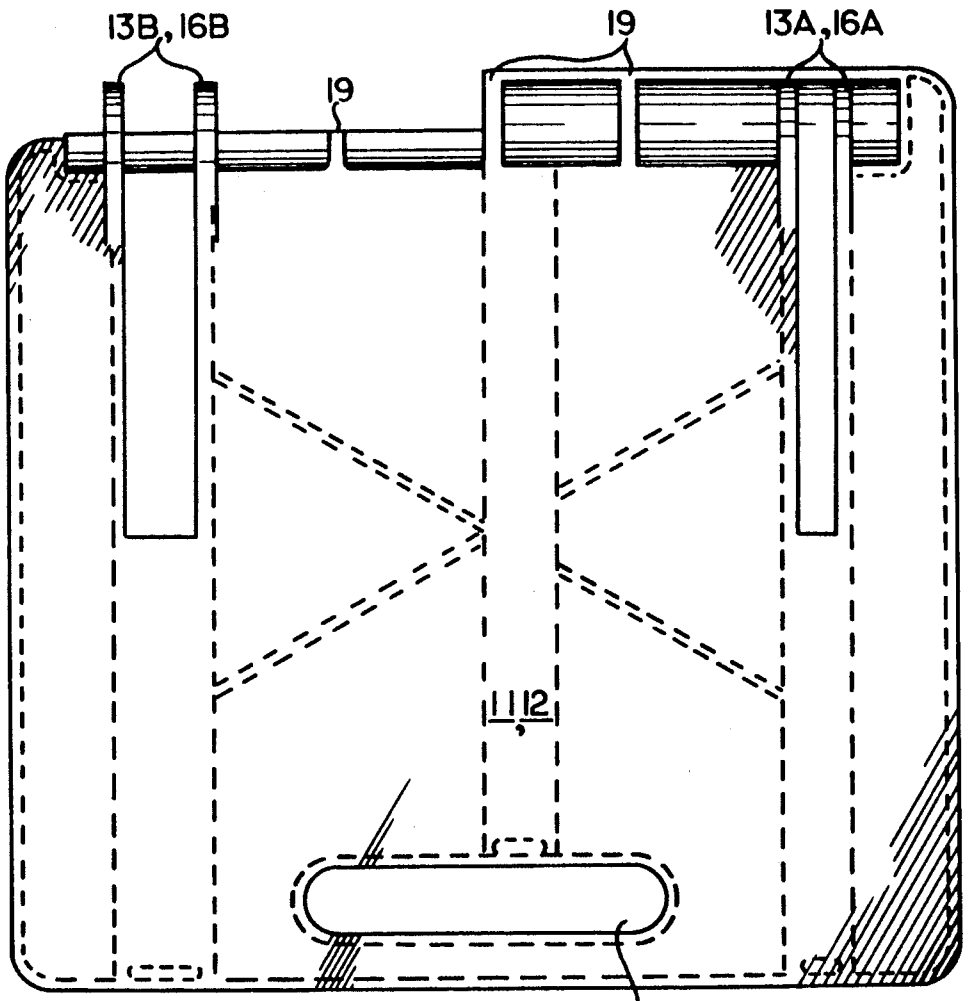
FIG. 3 is a top plan view of the seat member configuration.
Figure 4:
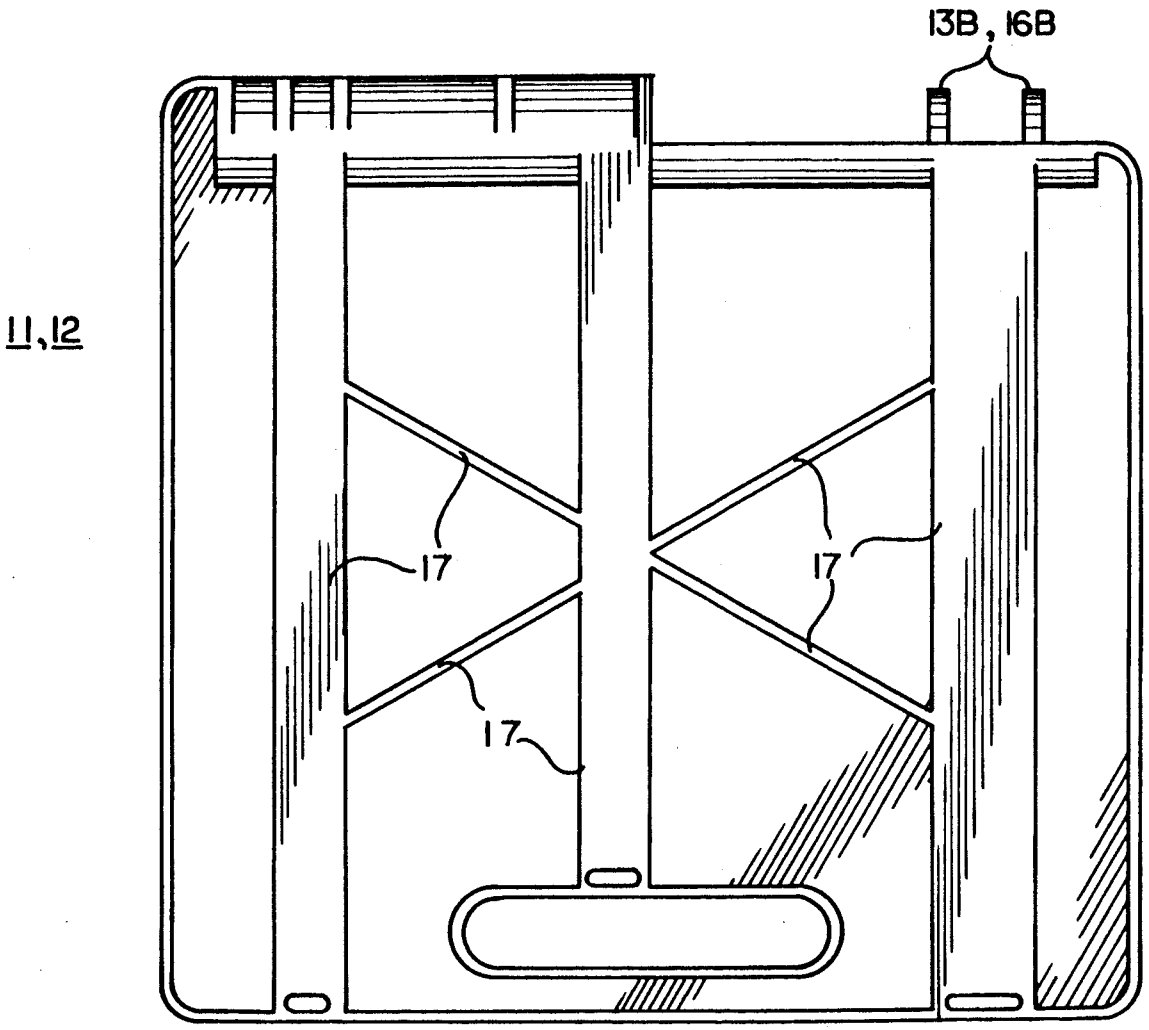
FIG. 4 is a bottom plan view of the seat member configuration.
Figure 5:
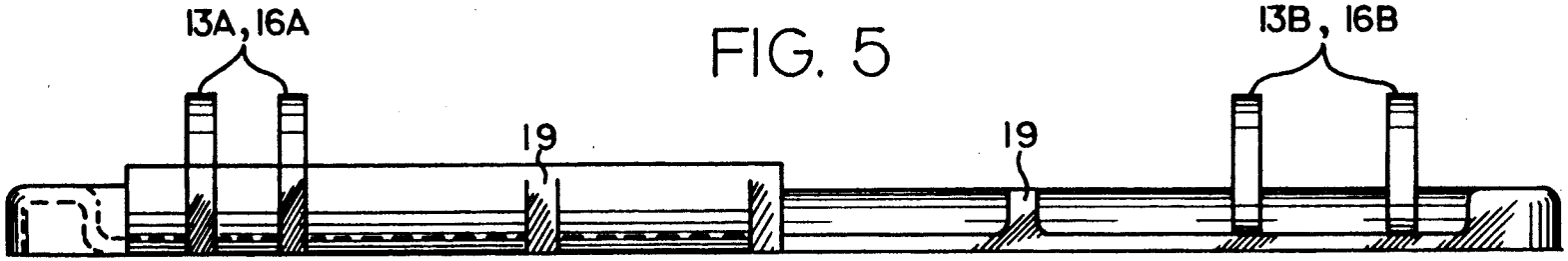
FIG. 5 is a rear edge view of the seat member configuration.
Figure 6:
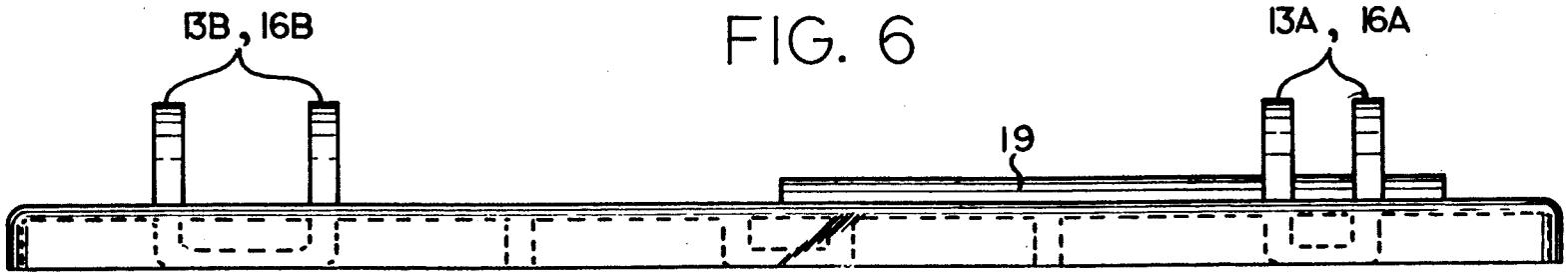
FIG. 6 is a front edge view of the seat member configuration.
Figure 7:
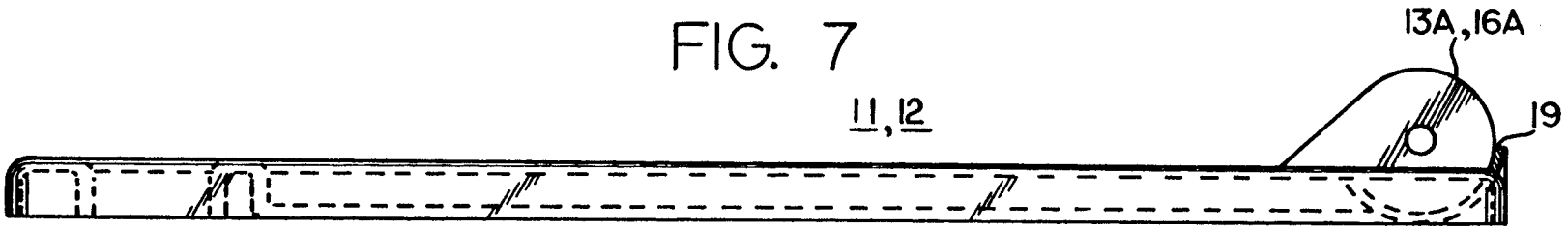
FIG. 7 is a first side edge view of the seat member configuration.
Figure 8:
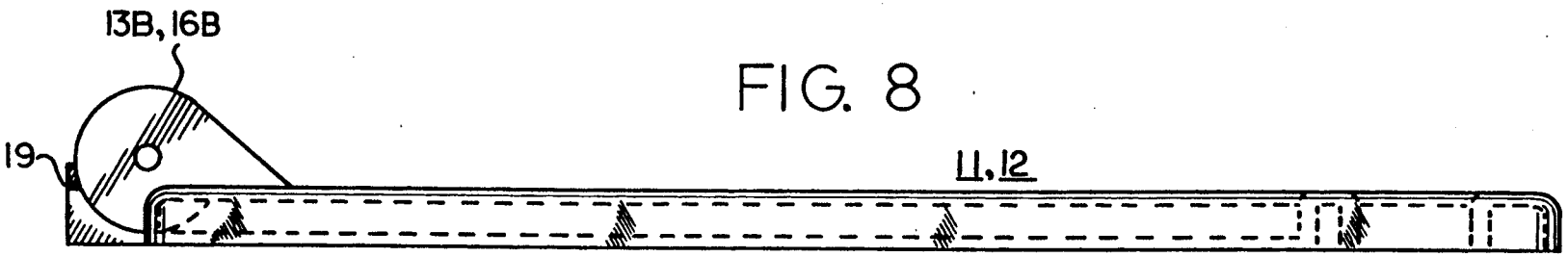
FIG. 8 is a second side edge view of the seat member configuration.

Referring specifically to FIGS. 1 through 8, a preferred embodiment of the instant invention is shown and will be referred to in the following description as foldable single mold stadium seat 10 is constructed from two identical seat members, here designated as first planar seat member 11 and second planar seat member 12. Both first and second planar seat members 11 and 12 have a rear edge having first and second ends and here designated as rear edges 11*a* and 12*a* formed along substantially the entire length of the end of the seat. A pair of hinges, first hinge 13 and second hinge 16 are attached at the rear edges 11*a* and 12*a* of first and second planar seat members 11 and 12. Hinges 13 and 16 are of identical and specific construction, and therefor only one detailed description will be given.

First hinge 13 is constructed from a first half 13*a* and a second half 13*b*. First half 13*a* includes a pair of hinge lugs attached to the rear edge of first seat member 11 at a specific narrow distance apart. Second hinge half 13*b* is attached along the rear edge 12*a* of second planar seat member 12 and has a pair of similar hinge lugs positioned at a specific wider distance apart. The hinge lugs of second hinge half 13*b* are spaced such that the hinge lugs of first hinge half 13*a* will interfit between the lugs of second hinge half 13*b*. Since first and second planar seat members 11 and 12 are formed of the same mold, they are identical in construction and obviously so is the construction of second hinge 16. However, for second hinge 16, the hinge halves 16*a* and 16*b* are reversed in their placement such that the first hinge half 16*a* is attached to rear edge 12*a* while second hinge half 16*b* is attached to rear edge 11*a*. With the lugs of first hinge half 16*a* interfiting between the lugs of second hinge half 16*b* and the lugs of first hinge half 13*a* interfiting between the lugs of second hinge half 13*b*, suitable hinge pins such as hinge pins 14 are installed to render first and second hinges 13 and 16 operable.

Radial stops 19 are also formed along rear edges 11*a* and 12*a* of first and second planar seat members 11 and 12. Radial stops 19 act to prevent first and second hinges 13 and 16 from rotating past the open position where first and second seat members 11 and 12 are generally perpendicular to one another. The open position corresponds to the normal seating position. The closed position has first and second seat members 11 and 12 generally parallel to one another to facilitate efficient transport and storage of foldable single mold stadium seat 10. When in the closed position, handle slots 18 align with one another to form a handle for carrying the stadium seat.

Advantageously, foldable single mold stadium seat 10 is manufactured using an injection molding process from a suitable high impact plastic and can include fiberglass reinforcing fibers.

Figure 9:
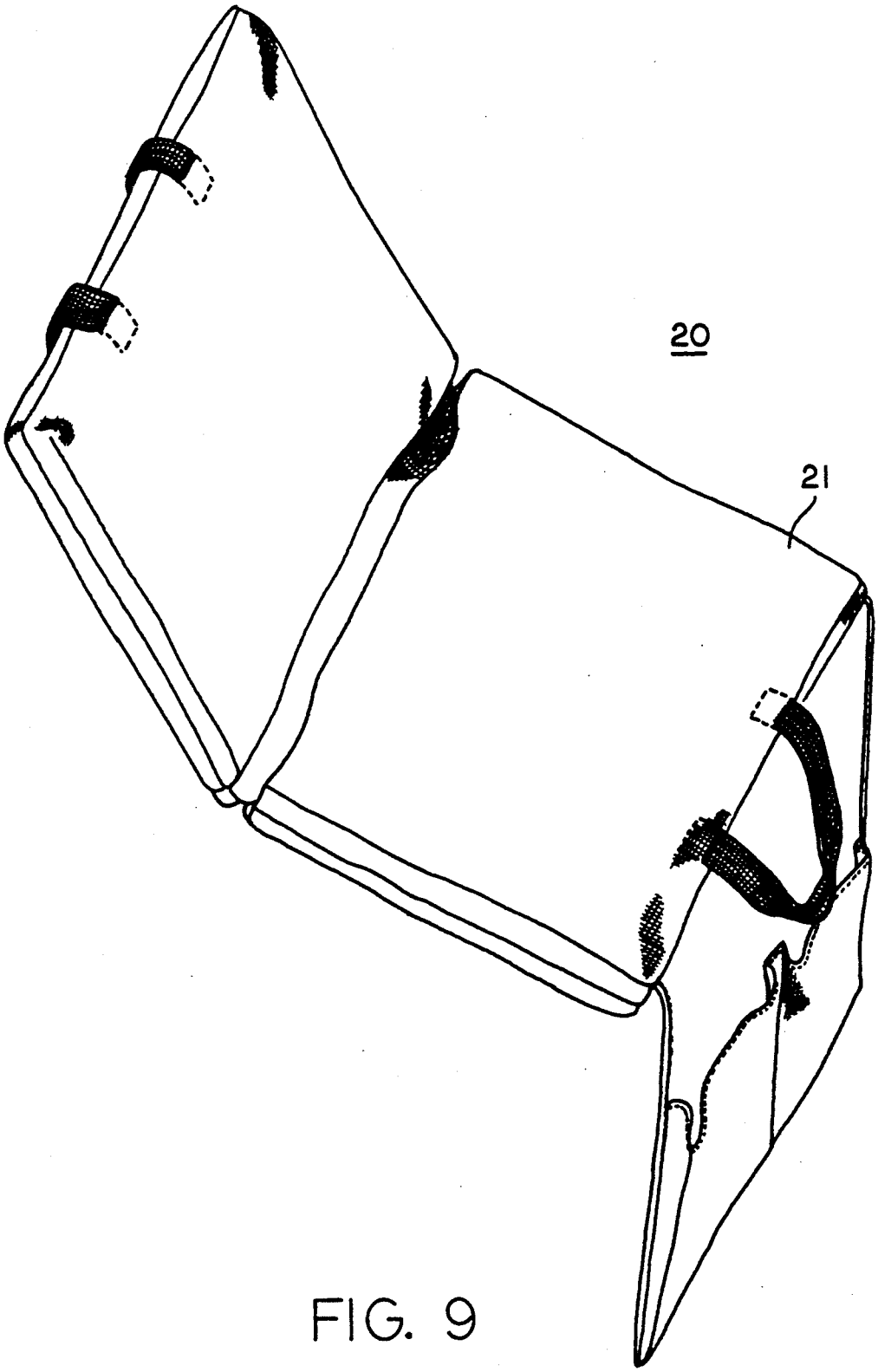
FIG. 9 is a ¾ elevation view of a seat cover/cushion for the foldable single mold stadium seat.
Figure 10:
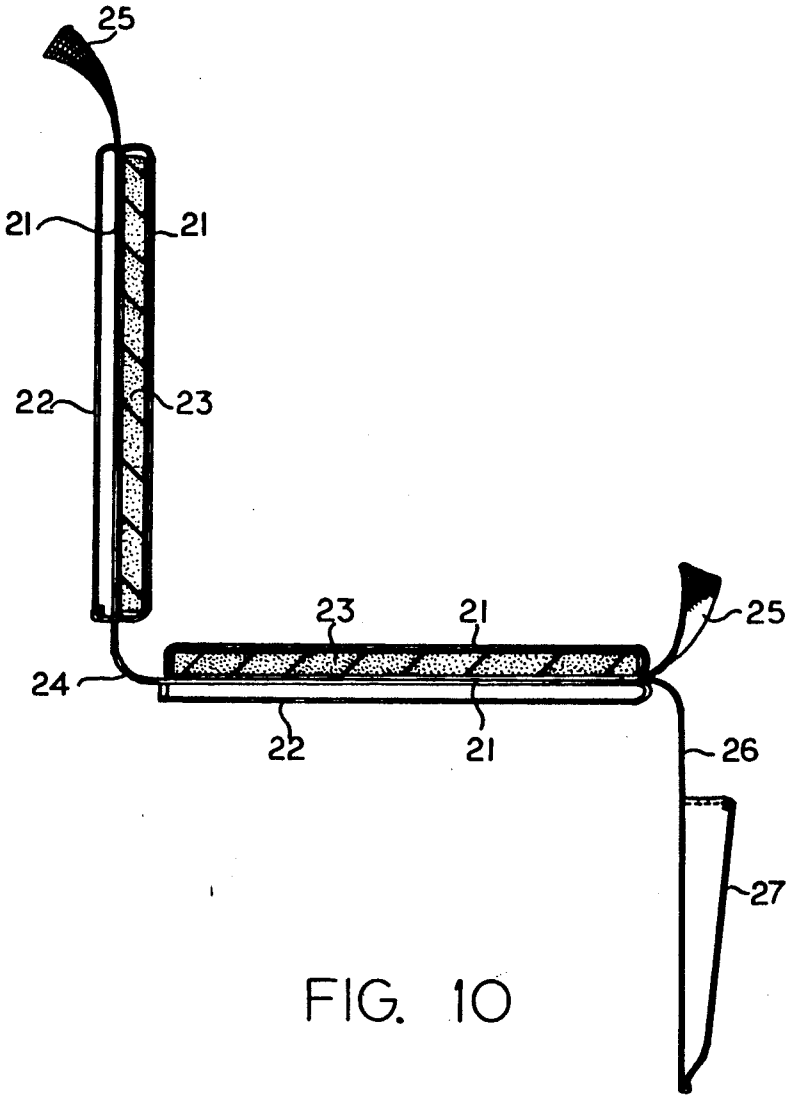
FIG. 10 is a medial side cross section view of the seat cover/cushion.

Referring now to FIGS. 9 and 10, a seat cover/cushion 20 is shown which is specifically configured to be used with the foldable single mold stadium seat 10. Seat cover/cushion 20 generally consists of a pair of cushions 23, each being encased in a fabric cushion case 21 and connected together via fabric hinge 24. A pair of fabric handles 25 are each attached to one of the fabric cushion cases 21 to provide a convenient mechanism for carrying seat cover/cushion 20. A pair of seat pocket forming panels 22 are each attached to a back side of one of the fabric cushion cases 21 and acts for form a pocket in which the first and second planar seat members 11 and 12 are slid. Once seat members 11 and 12 are slid into the pockets formed by seat pocket forming panels 22 and the stadium seat is opened into the sitting position, seat cover/cushion 20 will be held in place on foldable single mold stadium seat 10.

A depending fabric accessory panel 26 is attached along a front edge of one of the fabric cushion cases 21, to which an accessory pocket forming panel 27 is attached. Accessory pocket forming panel can contain a plurality of seams to define individual pockets for holding items such as a sports program, drinks, snacks or the like. Seat cover/cushion 20 is constructed according to standard methods of textile construction which are well known in the art.

While there is shown and described the present preferred embodiment of the invention, it is to be distinctly understood that this invention is not limited thereto but may be variously embodied to practice within the scope of the following claims.

Accordingly, what is claimed is:

1. A stadium seat which consists of:

a pair of identical generally planar seat members, hereinafter referred to as first and second seat members, each having a rear edge formed along substantially the entire length of the end of the seat;

a hinge being attached to and between the rear edges of said seat members and configured to pivot said seat members with respect to each other between an open position having said seat members disposed generally 100° apart, one to the other, and a closed position having said seat members generally parallel with each other;

said hinge having a first half and a second half where the first half is identical to the second half;

said first seat member having the first half of said hinge attached at a point on its rear edge;

said second seat member having the second half of the hinge attached at a point on its rear edge such that when said first and second seat members are aligned with their rear edges side by side, the first and second halves of said hinge will engage each other; and wherein radial stops formed along the entire length of said rear edges act to prevent said seat members from rotating past said open position.

2. A stadium seat which consists of:

a pair of identical generally planar seat members, hereinafter referred to as first and second seat members, each having a rear edge formed along substantially the entire length of the end of the seat;

a pair of hinges being attached to and between the rear edges of said seat members and configured to pivot said seat members with respect to each other between an open position having said seat members disposed generally 100° apart, one to the other, and a closed postion having said seat members generally parallel with each other;

each of said hinges having a first half and a second half where the first half of a first hinge is identical to a first half of a second hinge and likewise, the second half of the first hinge is identical to the second half of the second hinge;

said first and second seat members each having the first half of one of the hinges attached at a first end of its rear edge and the second half of the other hinge attached at a second end of its rear edge such that when said first and second seat members are aligned with their rear edges side by side, the first and second halves of the respective hinges will engage each other; and wherein radial stops formed along the entire length of said rear edge act to prevent said seat members from rotating past said open position.

* * * * *